US010158937B2

(12) United States Patent
Shao et al.

(10) Patent No.: US 10,158,937 B2
(45) Date of Patent: Dec. 18, 2018

(54) SPEAKER MODULE

(71) Applicant: GOERTEK INC., WeiFang, Shandong (CN)

(72) Inventors: Shuai Shao, WeiFang (CN); Chao Xu, WeiFang (CN); Lianwen Shan, WeiFang (CN)

(73) Assignee: GOERTEK INC., WeiFang, Shandong (CN)

( * ) Notice: Subject to any disclaimer, the term of this patent is extended or adjusted under 35 U.S.C. 154(b) by 36 days.

(21) Appl. No.: 15/508,052

(22) PCT Filed: Oct. 30, 2014

(86) PCT No.: PCT/CN2014/089888
§ 371 (c)(1),
(2) Date: Mar. 1, 2017

(87) PCT Pub. No.: WO2016/033860
PCT Pub. Date: Mar. 10, 2016

(65) Prior Publication Data

US 2017/0303033 A1 Oct. 19, 2017

(30) Foreign Application Priority Data

Sep. 1, 2014 (CN) ..... 2014 1 0440718

(51) Int. Cl.
*H04R 1/28* (2006.01)
*H04R 1/02* (2006.01)
(Continued)

(52) U.S. Cl.
CPC ..... *H04R 1/288* (2013.01); *H04R 1/025* (2013.01); *H04R 1/06* (2013.01); *H04R 9/025* (2013.01);
(Continued)

(58) Field of Classification Search
CPC combination set(s) only.
See application file for complete search history.

(56) References Cited

U.S. PATENT DOCUMENTS 5,448,637 A * 9/1995 Yamaguchi ..... H04M 1/05 379/430
8,594,351 B2 * 11/2013 Harlow ..... H04R 1/1016 381/309

FOREIGN PATENT DOCUMENTS

CN 1431850 A 7/2003
CN 201585119 U 9/2010
(Continued)

OTHER PUBLICATIONS

International Search Report dated May 25, 2015 of PCT/CN2014/089888 which is the parent application and its English translation—4 pages.
(Continued)

*Primary Examiner* — Amir Etesam
(74) *Attorney, Agent, or Firm* — Knobbe Martens Olson & Bear LLP

(57) ABSTRACT

A speaker module comprising a module housing is disclosed. A speaker unit is accommodated within the module housing. A sound hole of the module is located at a side of the speaker unit. The speaker unit divides a cavity of the entire module into two cavities, namely a front acoustic cavity and a rear acoustic cavity. The front acoustic cavity is in communication with the sound hole. A sound-absorbing cotton is provided in the front acoustic cavity. The sound-absorbing cotton is fixed on the module housing, and is arranged to avoid a vibration space of a diaphragm of the speaker unit. The present invention effectively improves the performance of a sensitivity curve of the module at high frequencies without modifying the structure of the front acoustic cavity, thus not only increasing the acoustic performance of the module, but also simplifying the structure of the front acoustic cavity of the module.

6 Claims, 5 Drawing Sheets

(51) Int. Cl.

| | |
|---|---|
| ***H04R 1/06*** | (2006.01) |
| ***H04R 9/02*** | (2006.01) |
| ***H04R 9/06*** | (2006.01) |

(52) U.S. Cl.
CPC ..... *H04R 9/06* (2013.01); *H04R 1/2865* (2013.01); *H04R 2499/11* (2013.01)

(56) References Cited

FOREIGN PATENT DOCUMENTS

| | | | |
|---|---|---|---|
| CN | 201629839 | U | 11/2010 |
| CN | 102157143 | A | 8/2011 |
| CN | 202799032 | U | 3/2013 |
| CN | 103108268 | A | 5/2013 |
| CN | 203225876 | U | 10/2013 |
| CN | 203590393 | U | 5/2014 |
| CN | 203708465 | U | 7/2014 |
| CN | 204046809 | U | 12/2014 |
| EP | 0535297 | A2 | 4/1993 |

OTHER PUBLICATIONS

Office Action dated Nov. 11, 2015 of corresponding Chinese Application No. 201410440718.2—9 pages.
Office Action dated Jul. 1, 2016 of corresponding Chinese Application No. 201410440718.2—5 pages.

* cited by examiner

SPEAKER MODULE

TECHNICAL FIELD

The present invention relates to the technical field of electro-acoustic products, particularly to a speaker module emitting sound at a lateral side.

BACKGROUND ART

The speaker module is an important acoustic component of a portable electronic apparatus, and is used for implementing conversion between an electronic signal and a sound signal, and the speaker module is an energy conversion device.

Along with the continuous development of the portable electronic apparatus towards a light, thin and small architecture, the speaker module, as the acoustic component of a portable electronic apparatus, also develops towards the light, thin and small architecture, and therefore, the technicians design more and more speaker modules to have a structure emitting sound at a lateral side of the front cavity. This kind of structure results in that most of sound waves emitted by a speaker unit cannot be directly spread out, but only can be spread out from the sound hole after being reflected by the walls of the front cavity, at which time, however, a standing wave may be formed in the front acoustic cavity after the transmitting waves and reflecting waves of some high frequency sound waves superimposed with each other, which results in the sound waves no longer moving forward, so that the sound waves in this frequency band would not spread out from the sound hole. This results in that the sound pressure amplitude decreases sharply at a high frequency point, and the sensitivity curve of the speaker module generates a deep valley near the high frequency point. As shown in the area of the dotted line in FIG. 9, the sensitivity curve of the speaker module generates a deep valley in the vicinity of the frequency of 10000 Hz, which seriously impacts on the sensitivity of the speaker module in this frequency band, reduces the acoustic performance of the module, and results in performance defects of the module.

SUMMARY

A technical problem to be solved by the present invention is to provide a speaker module which can effectively improve the deep valley phenomenon of the sensitivity at high frequencies, and can improve the acoustic performance of the speaker module.

In order to solve the above technical problem, the technical solutions of the present invention are as follows:

A speaker module comprising a module housing in which a speaker unit is accommodated, wherein a sound hole of the module is located at a lateral side of the speaker unit, an inner cavity of the module is divided into a front acoustic cavity and a rear acoustic cavity by the speaker unit, and the front acoustic cavity is in communication with the sound hole, wherein a sound-absorbing cotton is arranged in the front acoustic cavity, the sound-absorbing cotton is fixed on the module housing, and the sound-absorbing cotton is arranged to avoid the vibration space in which a vibrating diaphragm of the speaker unit vibrates.

As an implementation, the sound-absorbing cotton is arranged in the front acoustic cavity at the periphery of the speaker unit.

In particular, the speaker unit has a rectangular structure, and the sound-absorbing cotton is arranged in the front acoustic cavity at one side of the speaker unit.

In particular, the sound-absorbing cotton and the sound hole are arranged at two opposite sides of the speaker unit respectively.

In particular, the module housing comprises a first housing, a second housing, and a third housing which are combined together, and the front acoustic cavity is defined by the first housing, the second housing and the speaker unit; a groove is arranged on the second housing at one side of the speaker unit, the sound-absorbing cotton is arranged in the groove, and a space for sound waves to pass through is formed between a sidewall of the groove at a side of the groove closer to the speaker unit and the first housing; and the rear acoustic cavity is defined by the second housing, the third housing and the speaker unit.

In particular, the speaker unit comprises a vibration system and a magnetic circuit system, the vibration system comprises a vibrating diaphragm, an edge part of the vibrating diaphragm is fixed on the second housing, and a voice coil is fixed on one side of the vibrating diaphragm closer to the magnetic circuit system; an FPCB for electrically connecting a lead wire of the voice coil and an external circuit is arranged between the sound-absorbing cotton and a bottom of the groove, and one end of the FPCB extends to the outside of the front acoustic cavity to electrically connect with the external circuit.

In particular, the sidewall of the groove is provided with a notch at a position of the sidewall of the groove where the lead wire of the voice coil is coming out, and the lead wire of the voice coil passes through the notch and electrically connects with the FPCB.

As another implementation, the sound-absorbing cotton is fixed on an inner wall of the module housing at the sound hole.

As still another implementation, the sound-absorbing cotton is fixed on an inner wall of the module housing opposite to a sound emitting surface of the speaker unit.

As still another implementation, the speaker unit comprises a unit housing in which the vibration system and the magnetic circuit system are accommodated.

With the above technical solutions, the advantage effects of the present invention are as follows:

The sound hole of the speaker module of the present invention is located at the lateral side of the speaker unit, the speaker unit divides the whole inner cavity of the module into the front acoustic cavity and the rear acoustic cavity, the front acoustic cavity is in communication with the sound hole, and the sound-absorbing cotton is arranged in the front acoustic cavity. When the distance between a sound source and a reflecting surface of the front acoustic cavity (i.e., the inner wall of the housing which surrounds the front acoustic cavity) is equal to a quarter of the wavelength of one frequency in the high frequency band, a standing wave may be formed in the front acoustic cavity after the transmitting waves and the reflecting waves superimposed with each other. The present invention provides the sound-absorbing cotton in the front acoustic cavity, i.e., the sound-absorbing cotton is provided between the speaker unit and the reflecting surface of the front acoustic cavity, which equivalently lengthens the propagation distance of the sound waves in the front acoustic cavity, so that the position where the standing wave is generated is avoided, and the sensitivity of the speaker module at the high frequency band is effectively improved. Further, the sensitivity curve of the present invention is shown in FIG. 10, wherein the sensitivity curve at the frequency point in the area within the dotted line has obvious improvement compared to the sensitivity curve at the same frequency point in FIG. 9, thus the acoustic performance of the product is improved. The present invention effectively improves the performance of the sensitivity of the module at high frequencies without modifying the structure of the front acoustic cavity, which not only improves the acoustic performance of the module, but also simplifies the structure of the front acoustic cavity of the module.

In drawings: 10*a*, first housing; 10*b*, first housing; 10*c*, first housing; 12, sound hole; 14, blocking wall; 20*a*, second housing; 20*b*, second housing; 20*c*, second housing; 22, positioning column; 24, opening; 26, sidewall of the groove; 30, third housing; 40, speaker unit; 420, dome; 422, vibrating diaphragm; 424, voice coil; 426, lead wire of the voice coil; 440 yoke; 442, magnet; 444, washer; 50*a*, sound-absorbing cotton; 50*b*, sound-absorbing cotton; 50*c*, sound-absorbing cotton; 60, FPCB, 62, pad; 70, front acoustic cavity; 72, rear acoustic cavity.

DETAILED DESCRIPTION OF EMBODIMENTS

The present invention will be further described below in conjunction with the drawings and embodiments.

The upper orientation involved in the present specification refers to the direction of the vibration system of the speaker unit, while the lower orientation refers to the direction of the magnetic circuit system of the speaker unit. The inner side involved in the present specification refers to the side in the inner cavity of the speaker module, while the outer side refers to the side outside the inner cavity of the module.

Embodiment 1

Figure 1:
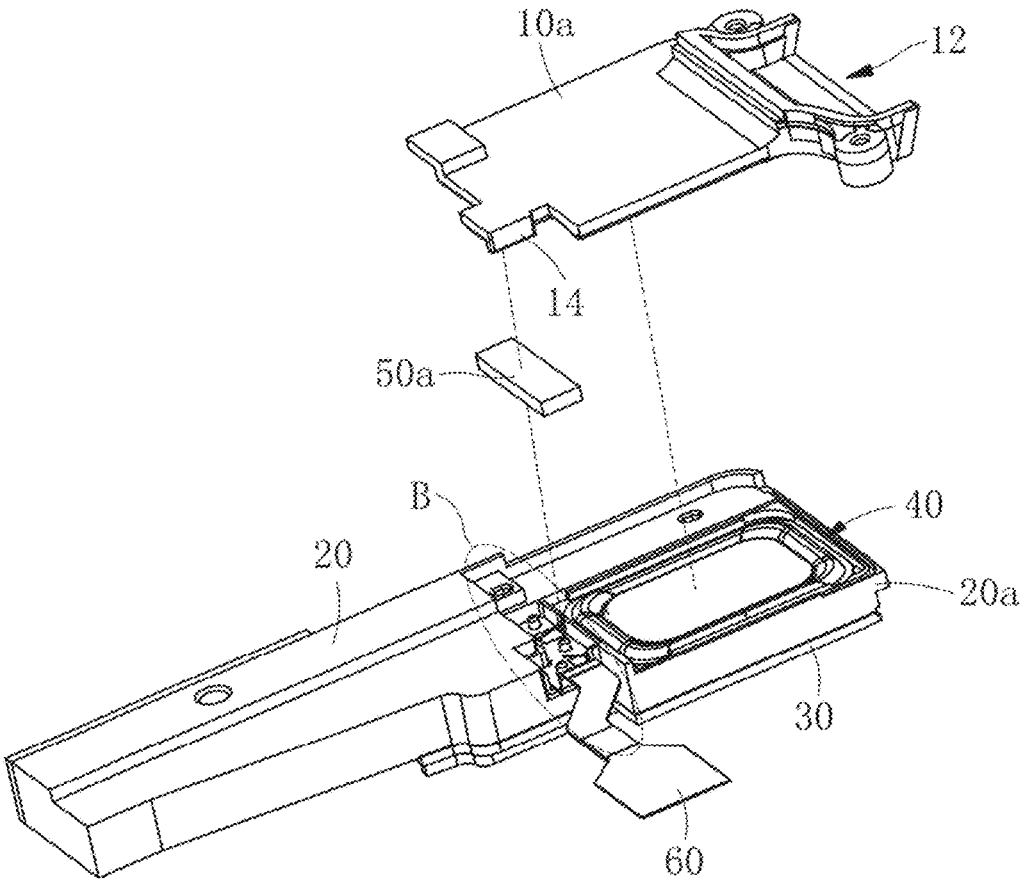
FIG. 1 is an exploded schematic view illustrating the three dimensional structure of embodiment 1 of a speaker module of the present invention.
Figure 2:
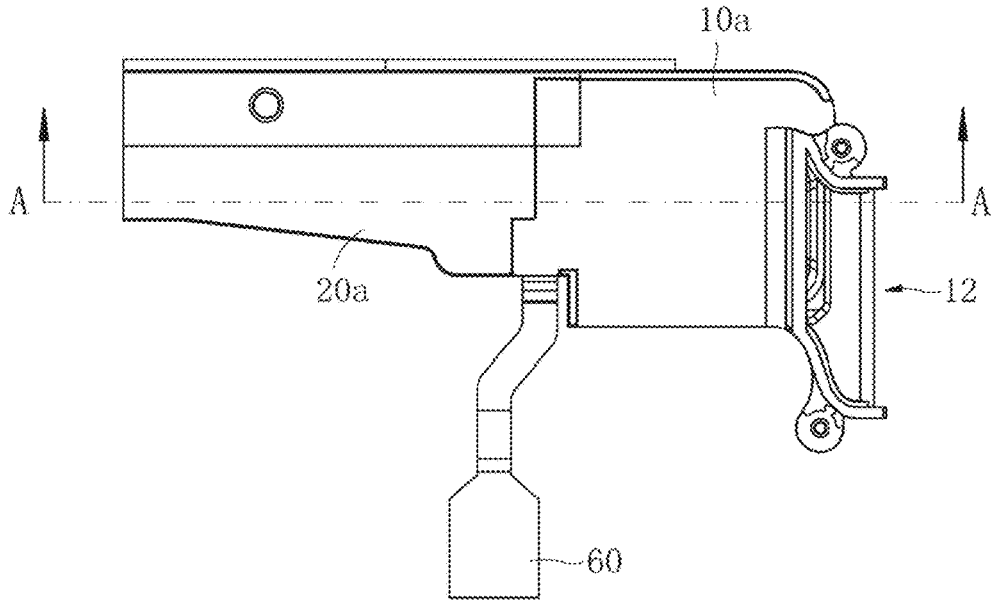
FIG. 2 is a schematic view illustrating the combined structure of FIG. 1.

As shown in FIG. 1 and FIG. 2, a speaker module comprises a module housing, which comprises a first housing 10*a*, a second housing 20*a* and a third housing 30 successively combined together, and the space defined by the first housing 10*a*, the second housing 20*a* and third housing 30 accommodates a speaker unit 40 having a rectangular structure. A sound hole 12 of the module is located at one side of the speaker unit 40, and the sound hole 12 is located on the first housing 10*a*.

Figure 3:
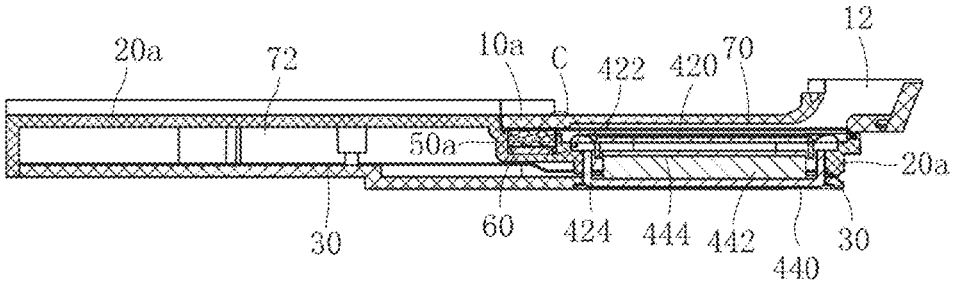
FIG. 3 is an enlarged sectional view taken along line A-A of FIG. 2.
Figure 5:
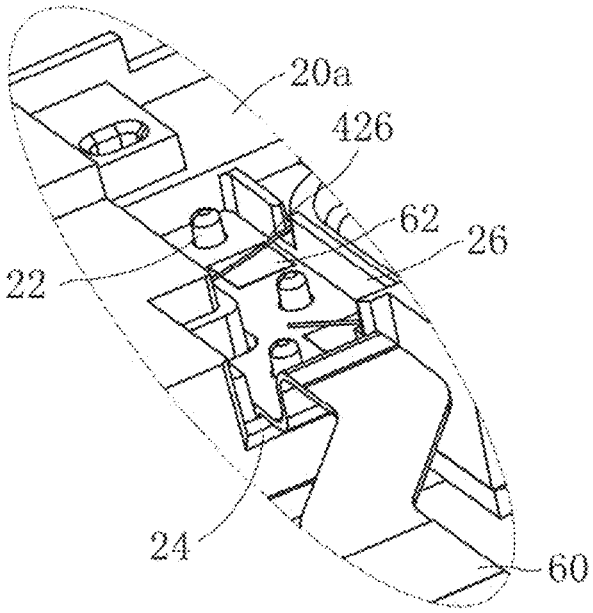
FIG. 5 is an enlarged view of part B of FIG. 1.

As shown in FIG. 3, the speaker unit 40 comprises a vibration system and a magnetic circuit system. The vibration system comprises a vibrating diaphragm 422, and the edge part of the vibrating diaphragm 422 is fixed on the second housing 20*a*; one side of the vibrating diaphragm 422 closer to the first housing 10*a* is provided with a dome 420 fixed on the central position of the vibrating diaphragm 422, and the other side of the vibrating diaphragm 422 is provided with a voice coil 424 fixed thereon. The winding tap of the voice coil 424 is the lead wire 426 of the voice coil (as shown in FIG. 5). The magnetic circuit system comprises a yoke 440, and the lateral side of the yoke 440 is fixed on the second housing 20*a*; the yoke 440 comprises a rectangular bottom, and each of four sides of the bottom is provided with a sidewall perpendicular to the bottom, and the central part of the bottom is provided with a magnet 442 and a washer 444 successively fixed thereon. A magnetic gap is arranged between the magnet 442 along with the washer 444 and the sidewalls of the yoke 440, and an end of the voice coil 424 is located in the magnetic gap. The voice coil 424 moves up and down in the magnetic gap according to the magnitude and polarity of an audio electronic signal passing through the winding of the voice coil, and the vibrating diaphragm 422 vibrates along with the voice coil 424 moving up and down, so as to stir up the air to generate sound, thus achieving the energy conversion from electricity to sound.

Figure 4:
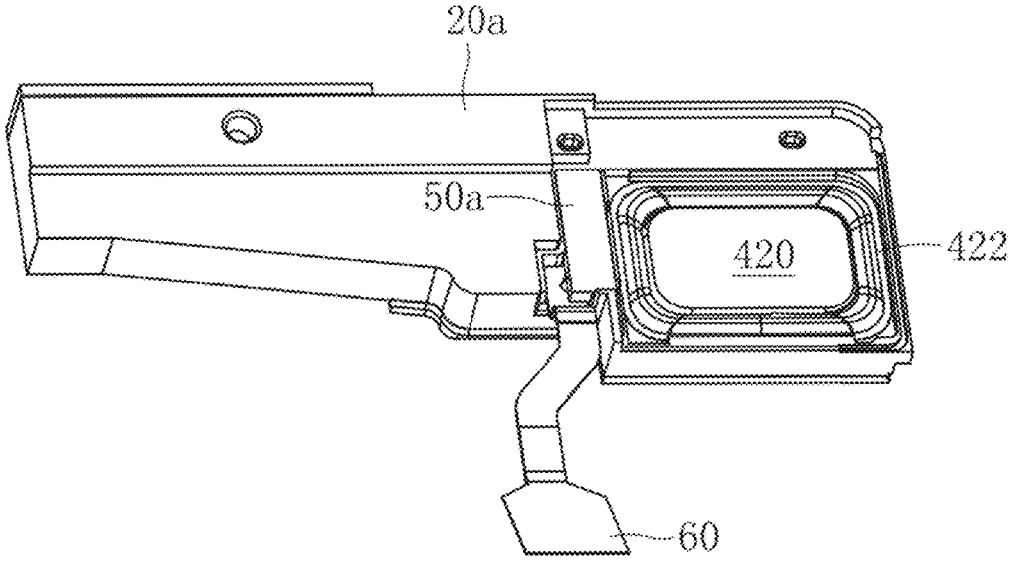
FIG. 4 is a schematic view illustrating the combined structure of FIG. 1 without the first housing.
Figure 6:
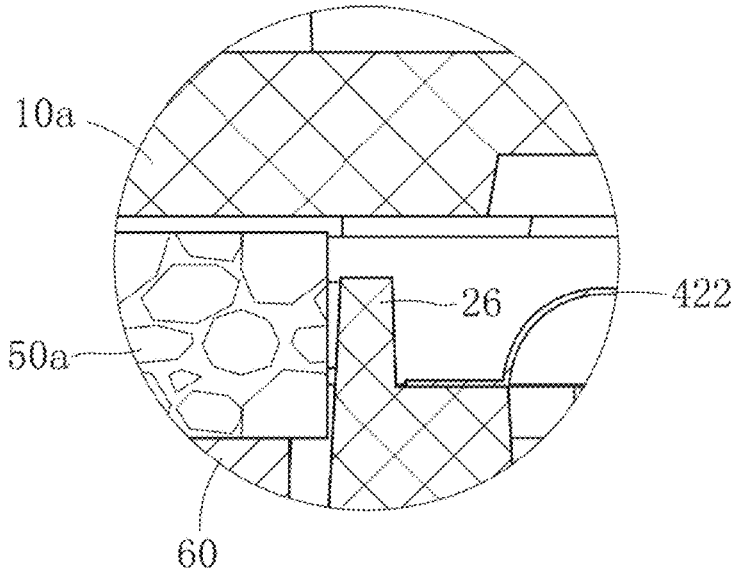
FIG. 6 is an enlarged view of part C of FIG. 3.
Figure 9:
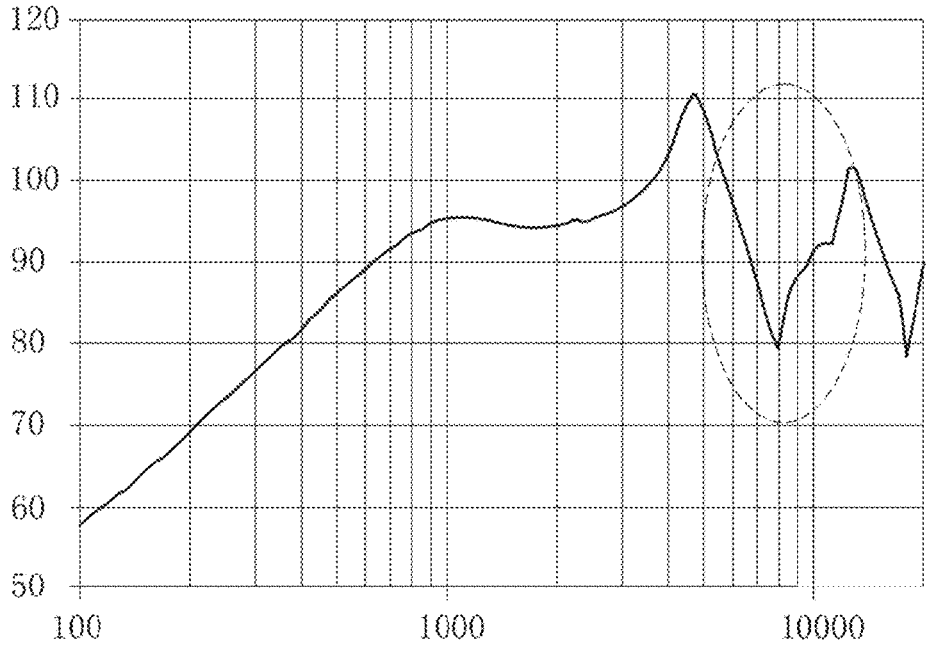
FIG. 9 is a sensitivity curve graph of the speaker module in the prior art.
Figure 10:
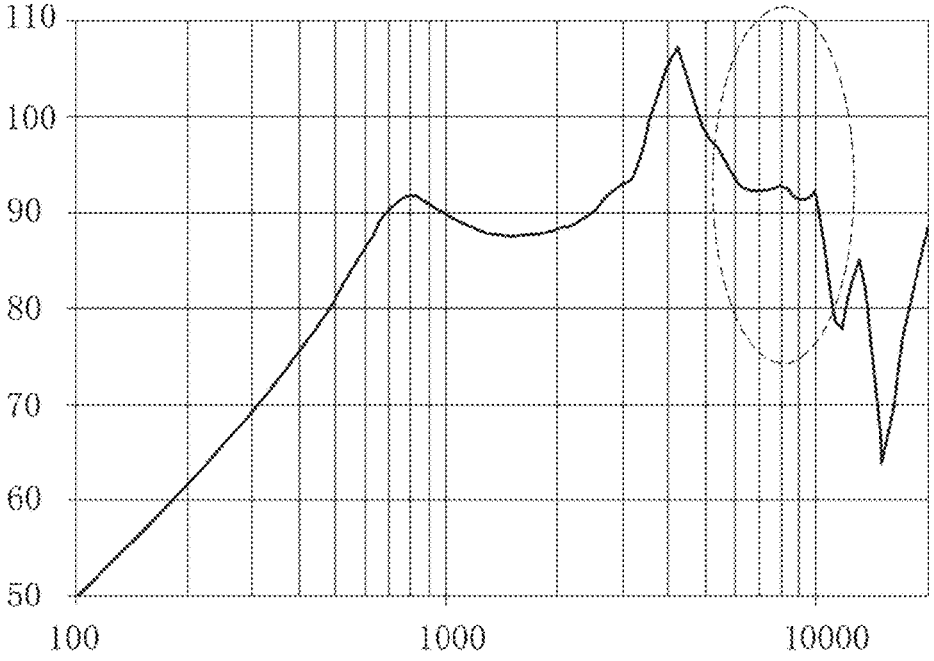
FIG. 10 is a sensitivity curve graph of the speaker module of the present invention.

As shown in FIG. 1, FIG. 3 and FIG. 4, the vibrating diaphragm 422 of the speaker unit 40 divides the whole inner cavity of the module into two cavities, i.e., a front acoustic cavity 70 and a rear acoustic cavity 72, wherein the first housing 10*a*, the second housing 20*a* and the vibrating diaphragm 422 jointly surround the front acoustic cavity 70, and the vibrating diaphragm 422, the second housing 20*a* and the third housing 30 jointly surround the rear acoustic cavity 72. The front acoustic cavity 70 is in communication with the sound hole 12. The sound-absorbing cotton 50*a* is arranged in the front acoustic cavity 70, a groove for accommodating the sound-absorbing cotton 50*a* is arranged on the second housing 20*a* at one side of the speaker unit 40, the sound-absorbing cotton 50*a* is provided in the groove, and the sound-absorbing cotton 50*a* and the sound hole 12 are located at two opposite sides of the speaker unit 40 respectively. The first housing 10*a* is located above the sound-absorbing cotton 50*a*, the sound-absorbing cotton 50*a* is sandwiched between the first housing 10*a* and the second housing 20*a*, and a space for sound waves to pass through is formed between a groove sidewall 26 of the groove closer to the speaker unit 40 and the first housing 10*a* (as shown in FIG. 6). The arrangement of the sound-absorbing cotton 50 equivalently lengthens the propagation distance of the sound waves in the front acoustic cavity 70, so that the position where the standing wave is generated is avoided, and the sensitivity of the module at the high frequency band is effectively improved, wherein a sensitivity curve is shown in FIG. 10. In FIG. 10, the sensitivity curve at the frequency point in the area within the dotted line has obvious improvement compared to the sensitivity curve at the same frequency point in FIG. 9, thus the acoustic performance of the product is improved. In addition, some module products in the prior art modify the structure of the front acoustic cavity to avoid the generation of the standing wave, but the modifying of the structure of the front acoustic cavity has to increase the complexity of the structure of the front acoustic cavity or increase the volume of the speaker module to lengthen the propagation distance of the sound wave in the front acoustic cavity. In comparison, the present invention can lengthen the propagation distance of the sound wave in the front acoustic cavity without modifying the structure of the front acoustic cavity, thus the better acoustic performance is achieved in the case of a smaller and simpler module structure.

As shown in FIG. 1, FIG. 3, FIG. 4 and FIG. 5, the module further comprises an FPCB 60 for electrically connecting the lead wire 426 of the voice coil with an external circuit, one end of the FPCB 60 is arranged between the sound-absorbing cotton 50*a* and the bottom of the groove and is fixed on the second housing 20*a*, and the other end of the FPCB 60 extends to the outside of the front acoustic cavity 70 and electrically connects with the external circuit. Three positioning columns 22 are arranged at the bottom of the groove, three positioning holes are arranged in the FPCB 60 at positions opposite to the three positioning columns 22 respectively, wherein the positioning columns 22 and the positioning holes cooperate with each other to fix the FPCB 60 on the second housing 20. Two pads 62 are arranged on the FPCB 60 between the three positioning holes, the sidewall 26 of the groove is provided with two notches at positions opposite to the two pads 62 (i.e., positions where the lead wire 426 of the voice coil is coming out), wherein the lead wire 426 of the voice coil passes through the notches and is welded with the pads 62. The sound-absorbing cotton 50*a* being arranged over the FPCB 60 fully utilizes the inner space of the module, which improves the sensitivity of the module at high frequency band without modifying the inner structure of the module and thus improving the acoustic performance of the module.

As shown in FIG. 1 and FIG. 5, an opening 24 corresponding to the width of the FPCB 60 is arranged in the second housing 20*a* at the position opposite to the FPCB 60, a blocking wall 14 mating with the opening 24 is arranged on the first housing 10*a* at the position opposite to the groove 24, and there is a gap left between the end of the blocking wall 14 and the bottom of the opening 24, wherein the FPCB 60 passes out of the front acoustic cavity 70 from the gap. Glues are applied at all connecting positions of the blocking wall 14, the opening 24 and the FPCB 60 for sealing.

As shown in FIG. 3, an opening hole corresponding to the size and shape of the bottom of the yoke 440 is arranged in the third housing 30 at the position opposite to the bottom of the yoke 440. When the module is assembled, the bottom of the yoke 440 is located in the opening hole, and the external surface of the bottom of the yoke 440 flushes with the external surface of the third housing 30. This kind of structure can effectively reduce the thickness of the module, allow the module to be more adaptable to a thin or ultra-thin type of electronic apparatus.

The structure and amount of the sound-absorbing cottons of the present invention are not limited to the above mentioned embodiment, and in practice, the technicians can design the structure, amount and position of the sound-absorbing cottons according to the structure of the front acoustic cavity of the module. For example, sound-absorbing cottons can be arranged at two sides, three sides or four sides of the speaker unit, and the sound-absorbing cottons can be integrally connected or can also be of separate structures. The technicians can make a selection thereof as appropriate.

Embodiment 2

Figure 7:
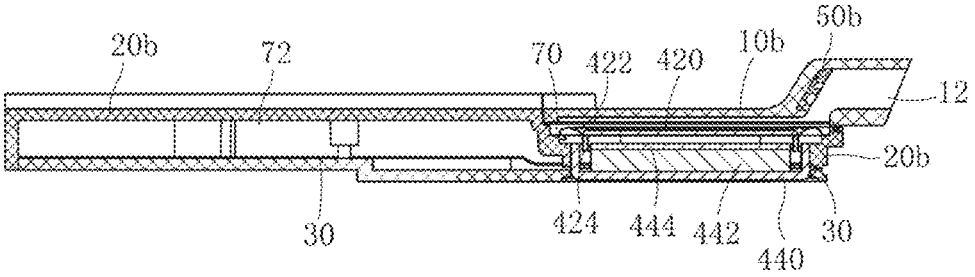
FIG. 7 is a schematic view illustrating the sectional structure of embodiment 2 of a speaker module of the present invention.

As shown in FIG. 7, embodiment 2 is basically identical to embodiment 1, and their difference lies in:

The sound-absorbing cotton 50*b* is fixed on the first housing 10*b*, instead of being fixed on the second housing 20*b*. The sound-absorbing cotton 50*b* is fixed on the inner side of the first housing 10*b* at the sound hole 12. The sound-absorbing cotton 50*b* is used for preventing the sound wave reflected onto the inner wall of the first housing 10*b* from generating a standing wave, and has a technical effect identical to that of embodiment 1.

Embodiment 3

Figure 8:
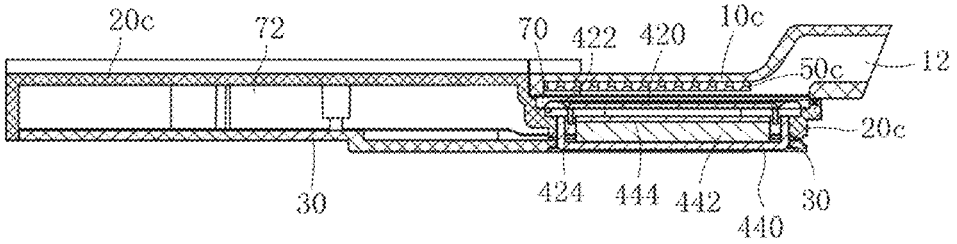
FIG. 8 is a schematic view illustrating the sectional structure of embodiment 3 of a speaker module of the present invention.

As shown in FIG. 8, embodiment 3 is basically identical to embodiment 1, and their difference lies in:

The sound-absorbing cotton 50*c* is fixed on the first housing 10*c*, instead of being fixed on the second housing 20*c*. The sound-absorbing cotton 50*c* is fixed over the speaker unit, i.e., on the inner wall of the first housing 10*c* opposite to the sound emitting surface of the speaker unit, and a space for the vibrating diaphragm to vibrate is formed between the sound-absorbing cotton 50*c* and the speaker unit. The sound-absorbing cotton 50*c* is used for preventing the sound wave reflected onto the inner wall of the first housing 10*c* from generating a standing wave, and has a technical effect identical to that of embodiment 1.

Embodiment 4

Embodiment 4 is basically identical to all of embodiment 1, embodiment 2 and embodiment 3, and the difference therebetween lies in:

The speaker unit comprises a unit housing, in which a vibration system and a magnetic circuit system are accommodated. The FPCB of the module extends to the outside from the rear acoustic cavity of the module, an end of the FPCB located in the rear acoustic cavity is electrically connected with the speaker unit, and an end of the FPCB extending to the outside of the rear acoustic cavity is electrically connected with an external circuit outside the module. Because the structure and installation of the FPCB are not the inventive points of the present invention, and they can all be implemented by those skilled in the art, the detailed descriptions of the structure and installation of the FPCB of the present implementation will be omitted herein.

The technical solution that the present invention adds the sound-absorbing cotton in the front acoustic cavity to improve the sensitivity of high frequency curve of the module is not limited to the structures of the module, the structures of the front acoustic cavity and the structures of the sound-absorbing cotton in the above mentioned embodiments. As long as the sound-absorbing cotton is arranged in the front acoustic cavity, and the sound-absorbing cotton is used for improving the sensitivity of high frequency curve of the module, the product is fall into the protection scope of the present invention, no matter whether the structure of the module, the structure of the front acoustic cavity and the structure of the sound-absorbing cotton are identical to those of the present invention or not.

The technical terms of the first housing, the second housing and the third housing mentioned in the present invention are only used for distinguishing technical features, and do not represent the installation sequence, work sequence and position relations of the three housings.

The present invention is not limited to the above specific embodiments. Various modifications made by those ordinary skilled in the art based on the above conception and without creative labor all fall into the protection scope of the present invention.

The invention claimed is:

1. A speaker module, comprising a module housing in which a speaker unit is accommodated, wherein a sound hole of the module is located at a lateral side of the speaker unit, an inner cavity of the module is divided into a front acoustic cavity and a rear acoustic cavity by the speaker unit, and the front acoustic cavity is in communication with the sound hole, wherein a sound-absorbing cotton is arranged in the front acoustic cavity, the sound-absorbing cotton is fixed on the module housing, the sound-absorbing cotton is arranged to avoid a vibration space in which a vibrating diaphragm of the speaker unit vibrates, and the sound-absorbing cotton is arranged in the front acoustic cavity at a periphery of the speaker unit, wherein the module housing comprises a first housing, a second housing, and a third housing which are combined together, and the front acoustic cavity is defined by the first housing, the second housing and the speaker unit, wherein a groove is arranged on the second housing at one side of the speaker unit, the sound-absorbing cotton is arranged in the groove, and a space for sound waves to pass through is formed between a sidewall of the groove at a side of the groove closer to the speaker unit and the first housing, wherein the rear acoustic cavity is defined by the second housing, the third housing and the speaker unit.

2. The speaker module according to claim 1, wherein the speaker unit has a rectangular structure, and the sound-absorbing cotton is arranged in the front acoustic cavity at one side of the speaker unit.

3. The speaker module according to claim 2, wherein the sound-absorbing cotton and the sound hole are arranged at two opposite sides of the speaker unit respectively.

4. The speaker module according to claim 1, wherein the speaker unit comprises a vibration system and a magnetic circuit system, the vibration system comprises a vibrating diaphragm, an edge part of the vibrating diaphragm is fixed on the second housing, and a voice coil is fixed on one side of the vibrating diaphragm closer to the magnetic circuit system; an FPCB for electrically connecting a lead wire of the voice coil and an external circuit is arranged between the sound-absorbing cotton and a bottom of the groove, and one end of the FPCB extends to outside of the front acoustic cavity to electrically connect with the external circuit.

5. The speaker module according to claim 4, wherein the sidewall of the groove is provided with a notch at a position of the sidewall of the groove where the lead wire of the voice coil is coming out, and the lead wire of the voice coil passes through the notch and electrically connects with the FPCB.

6. The speaker module according to claim 1, wherein the speaker unit comprises a unit housing in which a vibration system and a magnetic circuit system are accommodated.

* * * * *